US009622604B2

(12) United States Patent
Dexter

(10) Patent No.: US 9,622,604 B2
(45) Date of Patent: Apr. 18, 2017

(54) BED SKIRT ASSEMBLY

(71) Applicant: Tim Dexter, Orland, CA (US)

(72) Inventor: Tim Dexter, Orland, CA (US)

( * ) Notice: Subject to any disclaimer, the term of this patent is extended or adjusted under 35 U.S.C. 154(b) by 0 days.

(21) Appl. No.: 14/489,366

(22) Filed: Sep. 17, 2014

(65) Prior Publication Data

US 2015/0282646 A1 Oct. 8, 2015

Related U.S. Application Data

(60) Provisional application No. 61/995,115, filed on Apr. 4, 2014.

(51) Int. Cl.
*A47G 9/02* (2006.01)

(52) U.S. Cl.
CPC ..... *A47G 9/0292* (2013.01)

(58) Field of Classification Search
CPC ..... A47G 9/0292; A47G 9/04; A47G 9/0284; Y10T 24/23; Y10T 24/44009; Y10T 24/45267
See application file for complete search history.

(56) References Cited

U.S. PATENT DOCUMENTS 1,419,015 A * 6/1922 Homer ..... A47D 15/02 24/72.5
2,763,875 A 9/1956 Piontkowski
3,710,405 A * 1/1973 Watts ..... A47C 19/005 5/201
4,539,723 A * 9/1985 Hillsberry ..... A47C 27/085 24/72.5
4,769,865 A * 9/1988 Delaino ..... A47C 27/085 24/72.5
4,807,316 A * 2/1989 Whipple ..... A47G 9/0292 5/493
4,833,745 A * 5/1989 Delaino ..... A47C 27/085 24/72.5
5,005,237 A * 4/1991 Luchonok ..... A47C 27/085 24/72.5
5,335,383 A 8/1994 Schwind
5,715,553 A 2/1998 Baron et al.
5,802,637 A * 9/1998 Bordo ..... A47C 31/11 297/219.11
5,878,455 A * 3/1999 Patterson ..... A47C 19/021 248/345.1
6,457,194 B1 * 10/2002 Bennett ..... A47C 21/022 24/72.5
6,557,193 B1 * 5/2003 Griffith ..... A47G 9/0292 5/493
6,883,192 B1 * 4/2005 Rose ..... A47G 9/0292 24/72.5
7,207,078 B1 * 4/2007 Lakic ..... A47G 9/0284 5/493
7,676,863 B2 3/2010 Henning
2005/0188461 A1 * 9/2005 Peterson ..... A47G 9/086 5/413 R (Continued)

*Primary Examiner* — David E Sosnowski
*Assistant Examiner* — Myles Throop
(74) *Attorney, Agent, or Firm* — Lynette Wylie; Apex Juris, pllc

(57) ABSTRACT

The present invention comprises an assembly and method for a bed skirt employing a harness and skirting panel(s) adapted for removeable attachment thereto, and includes a cinching mechanism and stabilizing tongue stays to secure the assembly in fixed horizontal alignment.

19 Claims, 3 Drawing Sheets

(56) References Cited

U.S. PATENT DOCUMENTS

| | | | | |
|---|---|---|---|---|
| 2007/0022533 | A1* | 2/2007 | Borino | A47G 9/0284 5/493 |
| 2010/0058537 | A1* | 3/2010 | Schuck | A47G 9/02 5/493 |
| 2014/0000029 | A1* | 1/2014 | Masoncup | A47G 9/0292 5/493 |
| 2014/0090170 | A1* | 4/2014 | Mothorn | A47G 9/0292 5/493 |
| 2016/0007774 | A1* | 1/2016 | Kakabeeke | A47G 9/04 5/496 |

* cited by examiner

BED SKIRT ASSEMBLY

CROSS-REFERENCE TO RELATED APPLICATION

This application claims the benefit of U.S. Provisional Patent Application Ser. No. 61/995,115 filed on Apr. 4, 2014.

FIELD OF THE INVENTION

This invention relates to an assembly and system for a removeably attached bed skirt enclosure.

BACKGROUND OF THE INVENTION

Conventional bed skirts, also referred to as dust ruffles, typically extend downward from a flat horizontal sheet that is placed between a mattress and box spring of a bed to the floor to which the vertically extending skirt is permanently attached, and usually sewn. The enclosure formed helps keep dust from collecting and to hide the box spring, as well as, the space beneath the bed and items stored under the bed and thereby enclosed within the bed skirt. Due to their desirable function and esthetic appeal, bed skirts have become a common component of bedroom décor.

However, problems arise in maintaining the bed skirt due to movement of the bedding as a result of normal shifting of the mattress and bedding thereon in the regular course of shifting body positions or movement on and about the bed. A further problem with conventional bed skirts is the need to lift the mattress off the box spring or bed platform in order to insert or straighten the bed skirt, which entails a cumbersome and laborious process. Often, the lifting and repositioning of the mattress in order to install or even straighten the bed skirt requires more than one person. A yet further problem associated with such conventional bed skirts results from rips and tears of the flat horizontal sheet due to the force and friction that pulling on the bed skirt to straighten it in order to avoid the physical effort and inconvenience of lifting the mattress. Another disadvantage results from the unsightly appearance of an exposed area of the horizontal sheet and the disheveled skirt when normal shifting of the bed causes a portion of the bed skirt to be pulled down out of horizontal alignment. Prior art bed skirt systems such as shown in U.S. Pat. No. 5,715,553 adding Velcro to the flat sheet fail to address such and other disadvantages of the prior art. To the contrary, the added wear and tear that engaging and disengaging fastener strips upon the flat sheet exacerbates the dislevelling and ripping of the flat sheet inserted between the mattress and box spring of such prior art bed skirts.

Consequently, such and other problems with prior art bed skirt systems limit their use and at times cause consumers to forego their functional and decorative advantages. As a result, some do not employ dust ruffles in their bedding arrangements and others are prone to delay or avoid laundering or replacing a bed skirt that is no longer in clean or updated condition.

Bed skirt systems attempting to address such and other problems with conventional combinations replacing the horizontal flat sheet from which a vertically disposed bed skirt is attached or employing detachable bed skirts have been devised. Examples of such systems are provided in U.S. Pat. Nos. 5,715,553 and 5,335,383. However, such bed skirt assemblies' attachment substitutes for a horizontal sheet present further problems. A prevalent problem arises from unsightly irregular gathering, folding, stretching and detachment of the bed skirt due to instability of orientation, as well as, fragility or elasticity of the material of material, which detracts from the esthetic appearance and imposing the inconvenience entailed by adjustment needed to maintain smooth, uniform horizontal alignment of the bed skirts

SUMMARY OF THE INVENTION

The present invention addresses such and other disadvantages of the prior art with an assembly and method for providing a bedskirt employing a harness and skirting panel (s) adapted for removeable attachment thereto. The harness of the present invention comprises one or more first fastener strips which are attached to corner caps configured and spaced for mounted coupling with the upper corners of a corresponding box spring such that closure of the harness secures the first fastener strip in horizontal alignment about a surface along an outer perimeter of a box spring such that one or more corresponding skirting panels having a second fastener strip coactively attachable to the first fastener strip is affixed along the inner surface of the upper edge of the skirting panel skirting panel comprises a generally rectangular shape elongated along a horizontal axis and having an outer surface and an inner surface of an area defined within a first side edge and an opposing second side edge oriented in substantially perpendicular alignment with a lower edge and an upper edge, wherein the upper edge comprises a horizontally disposed length corresponding with the outer perimeter edges of the box spring, the side edges comprise a vertically disposed length extending the lower edge of the skirting panel proximal to the floor beneath the bed, and wherein. The skirting panel may comprise a single panel or multiple panels of a length suitably sized to cover exposed space about the sides, head and foot of the box spring. The quantity or extent of panels removeably attached to the harness may vary and is generally provided in accordance the orientation of the bed relative to the walls of a room such that the skirting panels at least cover an area beneath a bed opening to exposed sides not abutting a wall. For example, in a typical bedroom arrangement, the head of the bed abuts a wall and three panels are sufficient to cover, or hide the space and anything stored beneath a bed. Alternatively, if a bed is centered in a room and therefore abuts no walls, four skirting panels may be preferred. In a corner orientation wherein sides abut perpendicular walls, two panels may be displayed.

The present invention contemplates alternative modes for closing the harness to secure the one or more first fastener strips in secure horizontal alignment. A closure mechanism may employ a simple tie or provide a conventional clasp, hook and eye or similar means to directly connect ends of the first fastener material. Preferred embodiments of the bed skirt system may employ alternative releasable commercially available cinching mechanisms to tighten and engage the harness in secured horizontal alignment about the outer perimeter edges of the box spring. Such a cinching mechanism may comprise an eyelet lock incorporated into a first end of the first fastener strip such that the second end of the first fastener strip may be inserted therethrough to secure the first fastening strip in tightened engagement. The eyelet latch may be integrated into a corresponding box spring providing for integration of the harness therewith. Alternatively, the cinching mechanism may comprise a buckle, lever latch or other commercially available tighten-and-locking mechanism. In one preferred embodiment, a buckle may be attached one end of the first fastening material having a buckle and the second end of the first fastener material strip having corresponding eyelets positioned in spaced increments to adjust pressure exerted on the harness and thereby vary how taut the first fastener strip is held in secured horizontal alignment about the outer perimeter of the box spring. Such a closure mechanism is preferably positioned in or on the surface aligning the head of the box spring which often abuts a wall and thereby obscured from plain view. A releasable cinching mechanism may further comprises one end of the first fastening material having a lock and the second end of the first fastener material strip having a corresponding lever to cinch down the harness in fixed horizontal alignment about the outer perimeter of the box spring.

In a particularly preferred embodiment further described in the following detailed description, the first fastener strip comprises a flexible hook material and the second fastener strip comprises a coacting loop material. Such fastening strips are commercially available and known as Velcro.® It is contemplated that certain fabrics may directly coact with the hook material thereby obviating the use of a loop material along the upper edge of the relevant skirting panel.

Another inventive aspect detailed below are a plurality perpendicular tongue stays secured in transverse alignment to the first fastener strip so as to reinforce and thereby stabilize the fixed linear horizontal alignment of the first fastener strip about one or more surfaces of the outer perimeter of the box spring. A particularly preferred embodiment buttressing the reinforcement of the harness herein comprises a hooked extension or lip extending from a lower edge of a perpendicular tongue stays which may be tucked or inserted under the first fastener strip. Such tongue stays are preferably composed of plastic materials but any material of suitable rigidity may be used.

Many advantages emanate from the bed skirt assembly of the present invention. Removal of a flat sheet obviates the labor and time required to lift or move a mattress in order to adjust or replace a skirting panel. Eliminating the need to move the mattress enables a single person to easily install and change the bed skirt assembly. The readily detached and reattached bed skirting panels ease changing and thus cleaning, updating, utilizing reversible fabrics to improve the esthetic appeal and fresh scent and look of the bed skirt. Further advantages accrue from minimizing wear and tear on the bed skirt system, as well as box spring and mattress, thereby prolonging their attractive appearance and good condition. A yet further advantage is maintaining a more linear, uniform and orderly appearance of the bed skirt. These and other advantages of the present invention will be readily discernible to one skilled in the relevant art of bed skirt design and manufacture.

DETAILED DESCRIPTION OF THE PREFERRED EMBODIMENT

Figure 1:
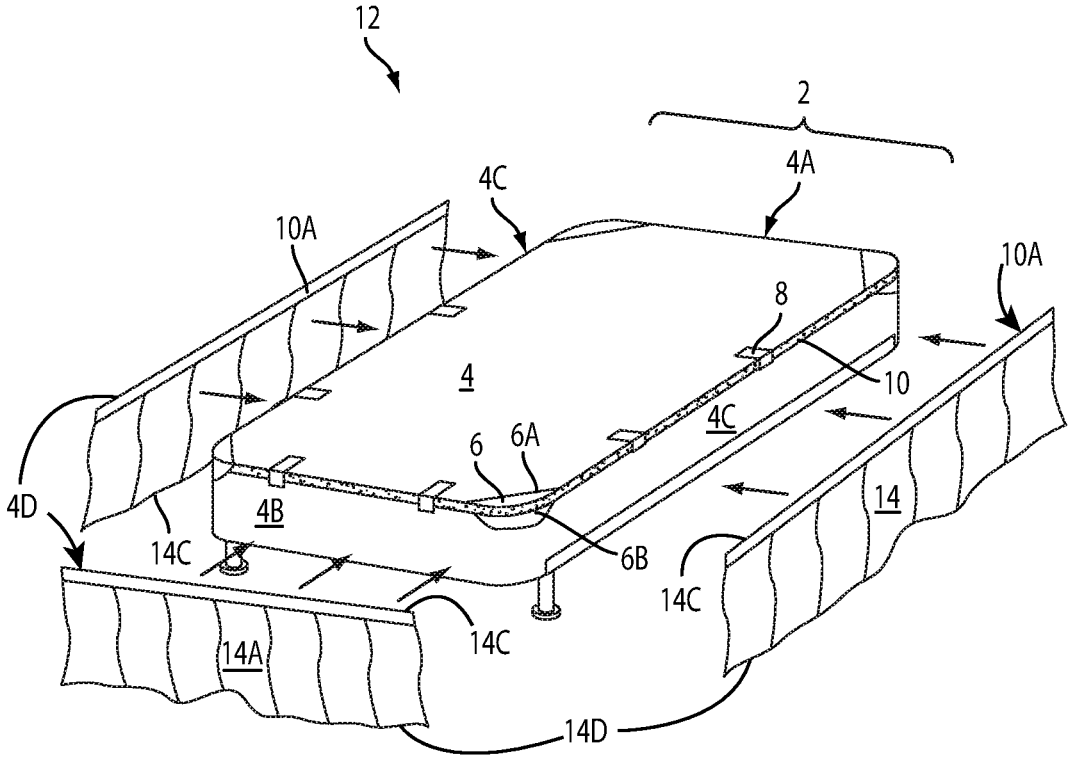
FIG. 1 is a side perspective view of a particularly preferred embodiment of the bed skirt assembly according to the present invention partially assembled.

Now referring to the particularly preferred embodiment shown in FIG. 1-5, bed skirt assembly 12 comprises a harness 2, skirting panels 14 and 14A, and perpendicular tongue stays 8. Harness 2 includes first fastener strips 10, preferably comprising a loop material, attached in spaced increments corresponding with a head end surface 4A, a foot end surface 4B and two opposing side surfaces 4C along the perimeter of a box spring 4. Fastener strips 10 are attached to four triangulate corner caps 6 comprised of upper triangular tab 6A and lower triangular tab 6B configured for fitted coupling upon upper corners of a box spring 4 in spaced correspondence such that mounting triangulate corner caps 6 to couple onto the upper corner of a box spring 4 a head end surface 4A, a foot end surface 4B and two opposing side surfaces 4C, wherein cinching a releasable closure mechanism 16 comprising a loop on a first end and inserting a second end of the harness 2 through and tying or engaging a coacting second fastener strip provided on the back side of the first hook fastener strips 10 to cinch the harness 2 in closed position secures first fastener strips 10 in fixed horizontal alignment about a head end surface 4A, a foot end surface 4B and two opposing side surfaces 4C, comprising the outer perimeter of box spring 4.

Figure 2:
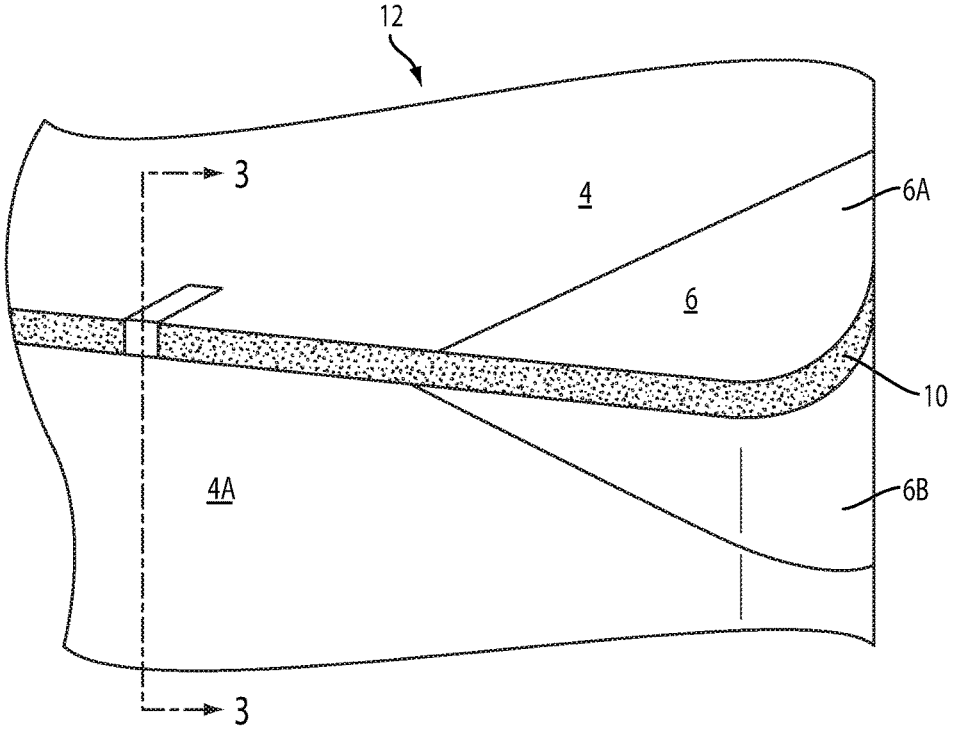
FIG. 2 is a sectional perspective view of an enlarged cutaway of the triangulate corner cap mounted in coupled correspondence on the upper corner of the box spring.
Figure 2A:
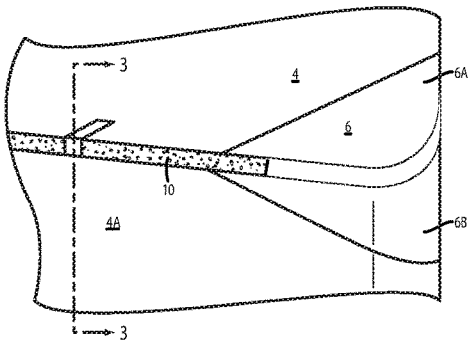

Still illustrating bed skirt assembly 12, FIG. 2 shows in an enlarged cutaway, triangulate corner caps 6 are composed of a pliable material cut into two generally triangular sections, upper triangular tab 6A and lower triangular tab 6B, which are attached, preferably by a sewn seam, to form a corner that couples in tight correspondence with the upper corners of box spring 4. Now referring to FIG. 2A, First fastener strips 10 extend lengths so when attached to triangulate corner caps 6, harness 2 may be closed to secure fastener strips 10 into fixed horizontal alignment about two opposing side surfaces 4C, a head end surface 4A, and a foot end surface 4B along the outer perimeter of box spring 4, which may be a predetermined size. For the queen size bed shown, first fastener strips 10 extending along the two opposing side surfaces 4C measure 80 inches, or 203 cm, and the first fastener strip 10 extending along foot end surface 4B measures 60 inches, or 153 cm. In alternative embodiments, first fastener strips will be provided to correspond with the relevant bed size, as can be readily ascertained by commonly available references delineating single, full, double, queen, king, and california king size beds. Moreover, alternative embodiments may employ one or more first fastener strips extending around all or a portion of the side surfaces 4C, foot end surface 4B and head end surface 4A.

Figure 3:
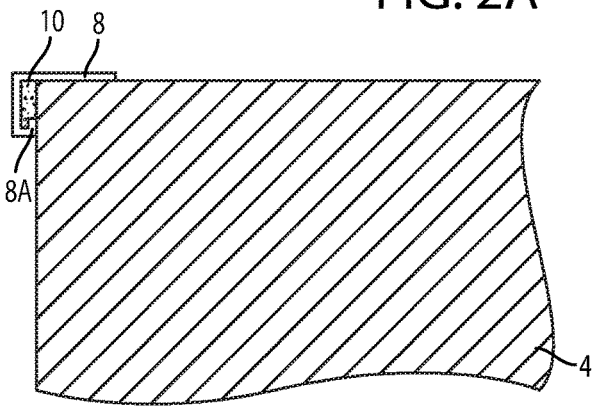
FIG. 3 is a sectional cross sectional view illustrating an enlarged cutaway of the reinforcing tongue stays affixing the first fastener strip in secure horizontal alignment.
Figure 4:
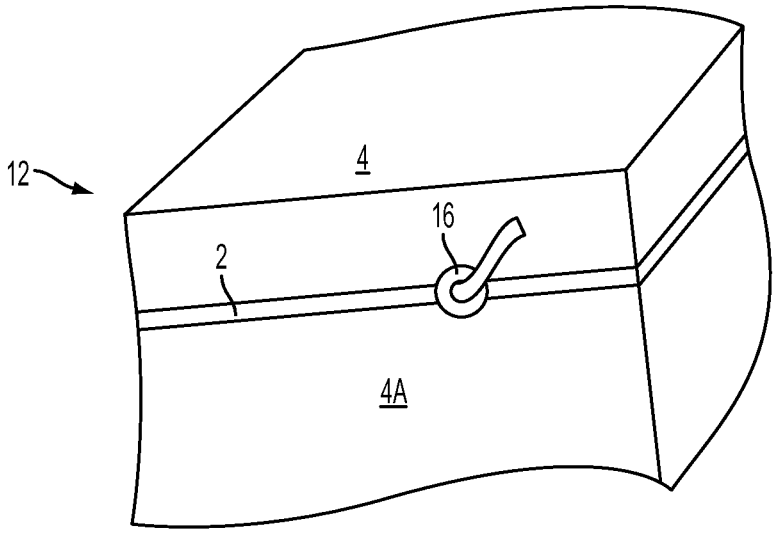
FIG. 4 is a sectional perspective illustrating an enlarged cutaway of the eyelet drawstring buckle of the particularly preferred embodiment of the present invention.
Figure 5:
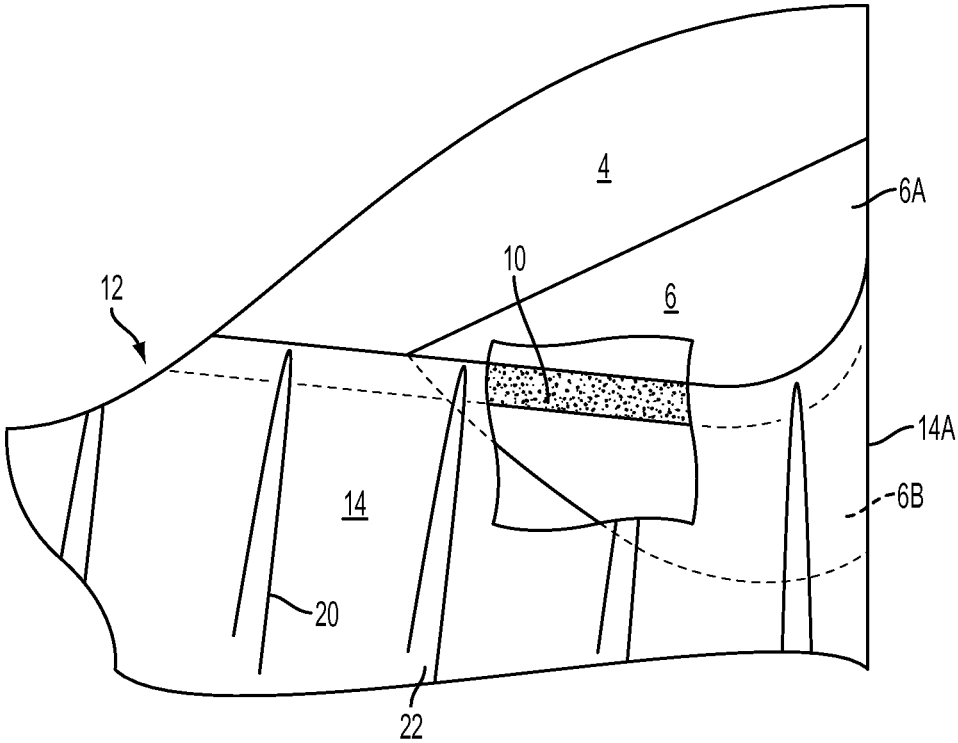
FIG. 5 is a sectional perspective view illustrating an enlarged cutaway of a particularly preferred embodiment of the present invention assembled.

As shown in FIG. 3, the illustrated particularly preferred embodiment provides a yet further means for securing first fastener strips 10 by affixing tongue stays 8 at spaced intervals to optimally reinforce linear and uniform horizontal alignment of along a perimeter coextensive with the box spring harness 2. As inserting a hooked end 8A of tongue stays 8 under first fastener strips 10 further reinforces their secured horizontal alignment about the perimeter of box spring 4. FIG. 4 illustrates an enlarged cutaway of a particularly preferred embodiment wherein eyelet/drawstring buckle 16 cinches harness 2 so as to secure first fastener strips 10 and 10A into fixed horizontal alignment.

Now referring back to FIG. 1, this particularly preferred embodiment further comprises two side skirting panels 14 and a foot end skirting panel 14A adapted for removeable attachment to first fastener strip 10 and second fastener strips 10A. As shown, skirting panels 14 and foot end skirting panel 14A are a generally rectangular shape and have an outer surface and an inner surface comprising an area defined by opposing vertically disposed side edges 14B and transversely opposing horizontally disposed lower edges and upper edges. Respective second fastener strip 10A coactively attachable to corresponding, first fastener strip 10 preferably comprising a loop material is then affixed along the inner surface 14B of the upper edge 14D of the side skirting panels and upper edge 14E of foot end skirting panel 14A respectively are then pressed down to engage in a smooth, uniform alignment with first fastener strip 10 along corresponding side surfaces 4A and foot end surface 4B of the box spring 4 such that the upper edges 14C of side skirting panels 14 and foot end skirting panel 14 A extend the length of side surfaces 4C of the box spring 4 and the upper edge 4D of the foot end skirting panel 14A extends the length so as to secure horizontally disposed alignment of the lower edge and upper edge 14D and 14E such that side skirting panels 14 and foot end skirting panel 14A extend a vertically disposed length downwardly suspending the lower edge 14D to thereby cover the space beneath the bed as illustrated in the enlarged cutaway view of the assemble bed skirt in FIG. 5.

In this particularly preferred embodiment, the skirting panels 14 and 14A further comprise a series of pleats 20 spaced at predetermined intervals folded along a vertically disposed axis of the outer surface perpendicular to the upper and lower edge. As shown, the pleats are secured to maintain a uniform line 22 along the vertical axis of the outer surface perpendicular to the upper and lower edge.

While a number of exemplary aspects and embodiments have been discussed above, those possessed of skill in the relevant art will recognize certain modifications, permutations, additions and sub-combinations thereof which are embraced within the inventive scope of the present bed skirt assembly. It is therefore intended that the following appended claims and claims hereafter are interpreted to include all such modifications, permutations, additions and sub-combinations as are within their true spirit and scope.

The invention claimed is:

1. A bed skirt assembly for covering a space beneath a box spring of a bed, comprising:

a harness for encompassing an outer perimeter of the box spring, the harness being comprised of a first fastener strip attached to a plurality of triangulate corner caps having two triangular sidewalls and an upper wall joined in perpendicular alignment, wherein the triangulate corner caps are configured and spaced apart for mounted coupling to upper corners of a box spring, the harness having a first end and a second end providing a closure mechanism such that closure of the first end and the second end tightens and secures the first fastener strip in fixed horizontal alignment about a surface vertically disposed along the outer perimeter of the box spring, the first end of the harness comprising a loop and the second end of the harness being configured for insertion through the loop, the second end of the harness further comprising a coacting material for detachable engagement with the first fastener strip so as to secure the first fastener in fixed horizontal alignment about the surface along the outer perimeter of the box spring; and one or more skirting panels adapted for removeable attachment to a corresponding section of the first fastener strip, the one or more skirting panels being a generally rectangular shape having an outer surface and an inner surface of an area defined by two opposing vertically disposed side edges and a horizontally disposed lower edge and upper edge, wherein the upper edge comprises a length corresponding to a surface along the outer perimeter of the box spring whereon the corresponding first fastener strip is in fixed horizontal alignment, and wherein the side edges comprise a vertically disposed length suspending the lower edge of the one or more skirting panels to cover the space beneath the bed when the upper edge is aligned with the corresponding first fastener strip, and wherein the inner surface of the upper edge of the skirting panel is removeably attachable to the corresponding first fastener strip.

2. The bed skirt assembly of claim 1, further comprising one or more second fastener strips coactively attachable to the corresponding first fastener strip, wherein the one or more second fastener strips are affixed to the inner surface of the upper edge of the one or more skirting panels.

3. The bed skirt assembly of claim 1, wherein the first fastener strip comprises a flexible hook material and the second fastener strip comprises a coacting flexible loop material.

4. The bed skirt assembly of claim 1, wherein the closure mechanism comprises the first end of the harness being a ring member and the second end of the harness being configured for insertion through the ring member such that the coacting loop material of the second fastener strip is in locked engagement with a corresponding material so as to secure the first fastener strip in fixed horizontal alignment about the surface along the outer perimeter of the box spring.

5. The bed skirt assembly of claim 1, wherein the closure mechanism further comprises the first end of the harness having a cinching mechanism a for securing the second end of the harness.

6. The bed skirt assembly of claim 1, wherein the closure mechanism comprises the first end of the harness being a lever lock and wherein the second end of the harness comprises a corresponding configuration for coupled engagement with the lever lock so as to secure the one or more first fastener strips in fixed horizontal alignment about the surface along the outer perimeter of the box spring.

7. The bed skirt assembly of claim 1, further comprising one or more tongue stays secured to the one or more first fastener strips so as to reinforce uniform, linear horizontal alignment thereof.

8. The bed skirt assembly of claim 7, wherein the tongue stays further comprise a hook end for insertion under the first fastener strip so as to reinforce uniform, linear horizontal alignment.

9. The bed skirt assembly of claim 7, wherein the skirting panel further comprises a series of pleats spaced at predetermined intervals folded along a vertically disposed axis of the outer surface perpendicular to the upper and lower edge.

10. A bed skirt assembly for covering a space beneath a bed, comprising:

a harness comprising a first fastener strip having a first end and a second end;

four triangulate corner caps having two triangular sidewalls and an upper wall joined in perpendicular alignment, wherein the four triangulate corner caps are configured and spaced apart for mounted coupling to upper corners of a box spring having an outer perimeter comprising a head end surface, a foot end surface and two opposing side surfaces providing a harness, wherein closure of the harness secures a releasable cinching mechanism tightening the first fastener strip in secured horizontal alignment about the outer perimeter of the box spring;

two side skirting panels adapted for removeable attachment to the first fastener strip, the side skirting panels being a generally rectangular shape having an outer surface and an inner surface comprising an area defined by opposing vertically disposed side edges and transversely opposing horizontally disposed lower edges and upper edges, wherein the upper edge of extends the length of the two opposing side surfaces of the box spring and, wherein a second fastener strip coactively attachable to the first fastener strip is affixed along the inner surface of the upper edge of the first side skirting panel;

a foot end skirting panel adapted for removeable attachment to the first fastener strip, the foot end skirting panel being a generally rectangular shape having an outer surface and an inner surface comprising an area defined by opposing vertically disposed side edges and a transverse horizontally disposed lower edge and upper edge, wherein the upper edge extends the length of the foot surface of the box spring and wherein the opposing side edges extend a vertically disposed length suspending the lower edge to cover the space beneath the bed;

a second fastener strip coactively attachable to the first fastener strip affixed along the inner surface of the upper edge of the skirting panel; and a releasable closure mechanism affixed to the first end of the first fastener strip, wherein the releasable closure mechanism comprises the second end of the harness being configured for insertion through a loop in the first end of the harness, and the second end of the harness further comprising a coacting material for detachable engagement with the first fastener strip so as to secure the first fastener in fixed horizontal alignment about the surface along the outer perimeter of the box spring.

11. The bed skirt assembly of claim 10, wherein the first fastener strip comprises a flexible hook material and the second fastener strip comprises a coacting loop material.

12. The bed skirt assembly of claim 10, wherein the releaseable closure mechanism is oriented at the head end surface of the box spring.

13. The bed skirt assembly of claim 10, further comprising one or more perpendicular tongue stays secured in transverse alignment to the first fastener strip so as to reinforce secured linear horizontal alignment of the first fastener strip about the outer perimeter of the box spring.

14. The bed skirt assembly of claim 10, wherein the closure mechanism one end of the first fastening material has a drawstring and the second end of the first fastener material strip has an eyelet latch to lock the harness in secured horizontal alignment about the outer perimeter edges of the box spring.

15. The bed skirt assembly of claim 10, wherein the two side skirting panels and the foot end skirting panel further comprise a series of pleats spaced at predetermined intervals, the pleats being folded along a perpendicular axis between the upper edge and the lower edge.

16. The bed skirt assembly of claim 10, wherein the series of pleats are secured to maintain a uniform fold along a perpendicular axis between the upper edge and the lower edge.

17. A method for covering a space beneath a box spring of a bed by affixing a harness about a surface along an vertically disposed perimeter of a box spring onto which one or more skirting panels adapted are removeably attached thereto, comprising the steps of:

mounting triangulate corner caps having two triangular sidewalls and an upper wall joined in perpendicular alignment and configured for fitted coupling onto corresponding upper corners of the box spring having a vertically disposed surface comprising a head end surface and an opposing foot end surface joined in perpendicular alignment with two opposing side surfaces defining a horizontally disposed upper and lower surface area comprising a bed size;

attaching a first fastener strip of a length corresponding to a surface about the perimeter of the box spring such that the first fastener strips and triangulate corner caps encompass a length corresponding to the surface along an outer perimeter of the box spring;

securing the harness such that the first fastener strips are secured in taut horizontal alignment about the outer perimeter of one or more side surfaces and the foot end surfaces of the box spring, the first end of the harness being a loop and the second end of the harness being configured for insertion through the loop, the second end of the harness further comprising a coacting material for detachable engagement with the first fastener strip so as to tighten and secure the first fastener strip in fixed horizontal alignment; and attaching an upper edge of a skirting panel having a generally rectangular shape elongated along a horizontal axis and having an outer surface and an inner surface of an area defined within a first side edge and an opposing second side edge oriented in substantially perpendicular alignment with a lower edge and an upper edge, wherein the upper edge comprises a horizontally disposed length corresponding with a surface of the outer perimeter edge of the box spring, such that the side edges descend a vertically disposed length extending the lower edge of the skirting panel to cover the space beneath the bed.

18. The method of claim 17, further comprising the step of:

cinching the harness in locked engagement to tighten and secure the first fastening strip in secured horizontal alignment about the outer perimeter of the box spring.

19. The method of claim 17, further comprising the step of:

securing a plurality of perpendicular tongue stays in affixed transverse alignment in spaced correspondence along the first fastener strip so as to reinforce linear horizontal alignment of the first fastener strip about a surface along the outer perimeter of the box spring.

* * * * *